United States Patent [19]

Wynn et al.

[11] 4,349,305

[45] Sep. 14, 1982

[54] LIFTING AND DUMPING APPARATUS

[75] Inventors: Charles C. Wynn, Maryville; Donald J. Hopkins, Knoxville, both of Tenn.

[73] Assignee: Dempster Systems Inc., Knoxville, Tenn.

[21] Appl. No.: 220,768

[22] Filed: Dec. 29, 1980

Related U.S. Application Data

[63] Continuation of Ser. No. 848,832, Nov. 1, 1977, abandoned.

[51] Int. Cl.[3] ..... B65B 21/02

[52] U.S. Cl. ..... 414/408; 91/516; 91/517; 414/403; 414/620; 414/669; 414/735

[58] Field of Search ..... 414/403, 406–410, 414/420, 422, 660–669, 621, 619–626, 670–671, 732–735; 91/516–518

[56] References Cited

U.S. PATENT DOCUMENTS

| | | | |
|---|---|---|---|
| 2,593,039 | 4/1952 | Livers et al. | 91/516 |
| 2,598,233 | 5/1952 | Deardorff | 91/517 |
| 2,653,624 | 9/1953 | Klessig | 91/516 |
| 2,844,942 | 7/1958 | Reynolds | 91/517 |
| 3,107,803 | 10/1963 | Glosup et al. . | |
| 3,122,250 | 2/1962 | French et al. . | |
| 3,147,870 | 9/1964 | Urban et al. | 414/408 |
| 3,266,650 | 8/1966 | Hauschild et al. . | |
| 3,827,587 | 8/1974 | Liberman et al. | 414/420 |
| 3,844,434 | 10/1974 | Blakeley et al. | 414/665 |
| 3,866,780 | 2/1975 | Miller et al. | 414/665 |
| 3,929,366 | 12/1975 | Keverline | 414/408 |

*Primary Examiner*—Trygve M. Blix
*Assistant Examiner*—R. B. Johnson
*Attorney, Agent, or Firm*—Jacox & Meckstroth

[57] ABSTRACT

A lifting and dumping apparatus for use with a front end loading refuse vehicle. The apparatus includes a pair of lift arms which extend forward of the cab of the vehicle and which are pivotally secured to the sides of the vehicle. A rotatable front tube extends between the front ends of the left arms, and a pair of fork arms are pivotally connected to the front tube. The fork arms can pivot between an open position and a closed position. In the open position the fork arms extend forward of the lift arms, generally perpendicular to the front tube for engagement with a detachable refuse container, and in the closed position the fork arms are generally parallel to the front tube so that their projection forward of the left arms is eliminated. Hydraulic cylinders are provided for pivoting the fork arms, and a hydraulic circuit is provided with a sequencing valve to close the fork arms one at a time.

3 Claims, 6 Drawing Figures

LIFTING AND DUMPING APPARATUS

This is a continuation, of application Ser. No. 848,832, filed Nov. 1, 1977 now abandoned.

BACKGROUND OF THE INVENTION

This invention relates to an improved materials handling apparatus, and more specifically to lifting and dumping equipment of the type used with a front end loading refuse vehicle.

Front end loading refuse vehicles, as commonly constructed, have an enclosed body with an opening or door at the top for receiving refuse. A U-shaped lift arm is pivotally mounted on each side of the vehicle frame rearward of the cab, and these lift arms are pivoted between a lower and an upper position by hydraulic cylinders secured to the vehicle frame rearward of the lift arms. In the lower position, the back portion of each lift arm extends down rearward of the cab and the front portion extends down forward of the cab; and in the upper position, the front portion is above the body of the vehicle. A rotatable front tube or cross member extends across the vehicle between the front ends of these lift arms and may be rotated by hydraulic cylinders secured to the lift arms. A pair of fork arms are mounted on the front tube for engagement with a detachable refuse container. The fork arms are generally perpendicular to the tube whereby rotation of the front tube causes the fork arms to rotate in a generally vertical direction about the axis of the tube.

To empty a detachable container, the refuse vehicle is positioned directly in front of the container with the lift arms in their lower position and the fork means substantially horizontal. The container has sides spaced apart slightly less than the distance between the fork arms, and the sides of the container are provided with sleeves that can receive the fork arms. The vehicle is then moved forward to insert the fork arms into the sleeves; and then the lift arms, the front tube, and the fork arms are operated simultaneously to lift the refuse container above the body of the vehicle, maintain the container generally upright until it is above the body of the vehicle, and then invert the container to dump its contents into the body of the vehicle. To return the container to the ground, the movement of the lift arms, the front tube, and the fork arms is reversed. When the container is on the ground, the vehicle is moved backwards to disengage the fork arms from the container sleeves, and the vehicle can then proceed to the next container.

After disengaging a container, the fork arms are substantially horizontal and extend forward of the front ends of the lift arms. The vehicle can operate in the running mode with the form arms in this position; but, typically, when the vehicle is in transit, the fork arms are swung upwards in a vertical plane about the axis of the front tube. This is done by rotating the front tube by means of the hydraulic cylinders secured to the front portions of the lift arms and connected to the tube by levers, and this has the effect of increasing the vehicle's maneuverability by decreasing the effective length of the vehicle. However, before a second container can be engaged, the operator of the vehicle must realign the fork arms to a substantially horizontal position, and this horizontal realignment can consume a significant portion of the operator's time. Another disadvantage to pivoting the fork arm upwards about the axis of the front tube is that this may move the fork arms into a position where they may interfere with the vision of the operator of the vehicle. In addition, the fork arms cannot swing upwards far enough, simply by rotating the front tube, to eliminate their projection forward of the front ends of the lift arms, and this limits the extent to which the maneuverability of the vehicle can be increased by so moving the fork arms.

SUMMARY OF THE INVENTION

An object of this invention is to improve equipment for lifting and dumping detachable refuse containers into front end loading refuse vehicles.

Another object of this invention is to improve front end loading refuse vehicles.

A further object of this invention is to increase the maneuverability of front end loading refuse vehicles.

A still further object of this invention is to provide a lifting and dumping apparatus for a front end loading refuse vehicle that decreases the extent to which the fork arms of the apparatus interfere with the maneuverability of the vehicle without requiring a horizontal realignment of the fork arms before they can engage a detachable container.

A fifth object of this invention is to provide a lifting and dumping apparatus for a front end loading refuse vehicle that eliminates the forward projection of the fork arms when the vehicle is in a running mode of operation.

These and other objectives are achieved by a new and improved lifting and dumping apparatus that is used with a front end loading refuse vehicle. The fork arms of the apparatus are each pivotally connected by bracket plates and a pin to a rotatable front cross member which extends transverse of the vehicle between the front ends of the lift arms of the apparatus. The fork arms can pivot in a horizontal plane about the pins between an open or extended position and a closed or folded position. In the open position the fork arms extend forward of the lift arms generally perpendicular to the front tube for engagement with a detachable refuse container, and in the closed position the fork arms are generally parallel to the front tube so that their projection forward of the lift arms is eliminated. The apparatus is provided with hydraulic cylinders to pivot the fork arms about the pins joining the fork arms to the front tube, and with a hydraulic fluid circuit which connects the cylinders to a reservoir of hydraulic fluid. The fluid circuit contains a sequencing valve which completely closes one arm before the second arm starts to close. Sequencing the closing or folding of the fork arms in this manner prevents the fork arms from striking and blocking each other as they close.

Further benefits and advantages of the invention will become apparent from a consideration of the following description given with reference to the accompanying drawings which specify and show a preferred embodiment of the invention.

DESCRIPTION OF THE PREFERRED EMBODIMENT

Figure 2:
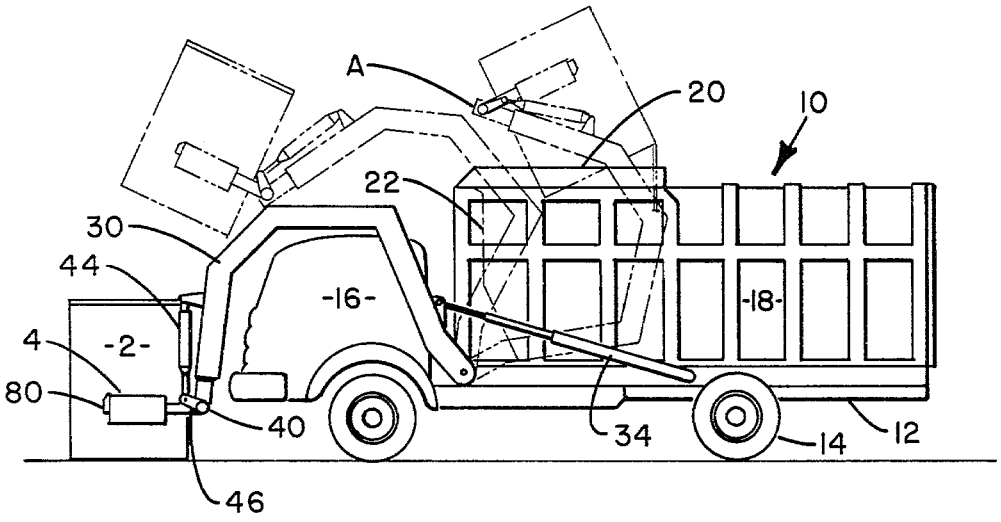
FIG. 2 is a side elevational view of a front end loading refuse vehicle using the lifting and dumping apparatus shown in FIG. 1.

Referring now to FIG. 2, there is illustrated a self-propelled front end loading refuse vehicle generally designated 10. The vehicle 10 includes a chassis frame 12 supported by road wheels 14 and has the usual cab 16 which houses the operator and the controls. A refuse body 18 is supported on the chassis 12 behind the cab 16 and has an opening 20 at the top through which refuse may be dumped into the interior of the body. Typically, the body 18 includes a movable packer head 22 for compacting the refuse towards the rear of the body.

The vehicle 10 also includes a pair of lift arms 30 positioned on opposite sides of the vehicle and spaced apart from each other a distance greater than the width of the cab 16 and of the body 18. These lift arms 30 are usually of inverted U-shape, and the back ends of the lift arms are pivotally secured to the body 18 rearward of the cab 16. The lift arms 30, thus, can swing with respect to the body 18 between a lower position, shown in full lines in FIG. 2, and an upper position indicated in broken lines at A in FIG. 2. In the lower position, the front end portion of each lift arm 30 extends down forward of the cab 16, the back end portion extends down rearward of the cab, and the mid portion extends above the door of the cab. In the upper position, the front end portion of each lift arm extends above the body 18. At each side of the body 18 a hydraulic cylinder 34, referred to as a lifting hydraulic cylinder, is positioned rearward of the lift arms 30 for swinging the lift arms between the upper and lower positions.

The front ends of the lift arms 30 are connected together by a tube or cross member 40 which extends transversely of the chassis 12 and which, in a preferred embodiment, is rotatably supported by the lift arms. Hydraulic cylinders 44, referred to as the dumping hydraulic cylinders, are position on the front portions of the lift arms 30 for rotating this front tube 40. The head end of each dumping hydraulic cylinder 44 is pivotally connected to the front portion of a lift arm 30 above the front tube 40, and the piston rod of each cylinder 44 is pivotally connected to levers 46 which, in turn, are secured to the front tube 40. When the piston rods of the dumping hydraulic cylinders 44 are drawn inwardly, the levers 46 swing upwards causing the front tube 40 to rotate about its own axis in a clockwise direction as viewed in FIG. 2.

Figure 1:
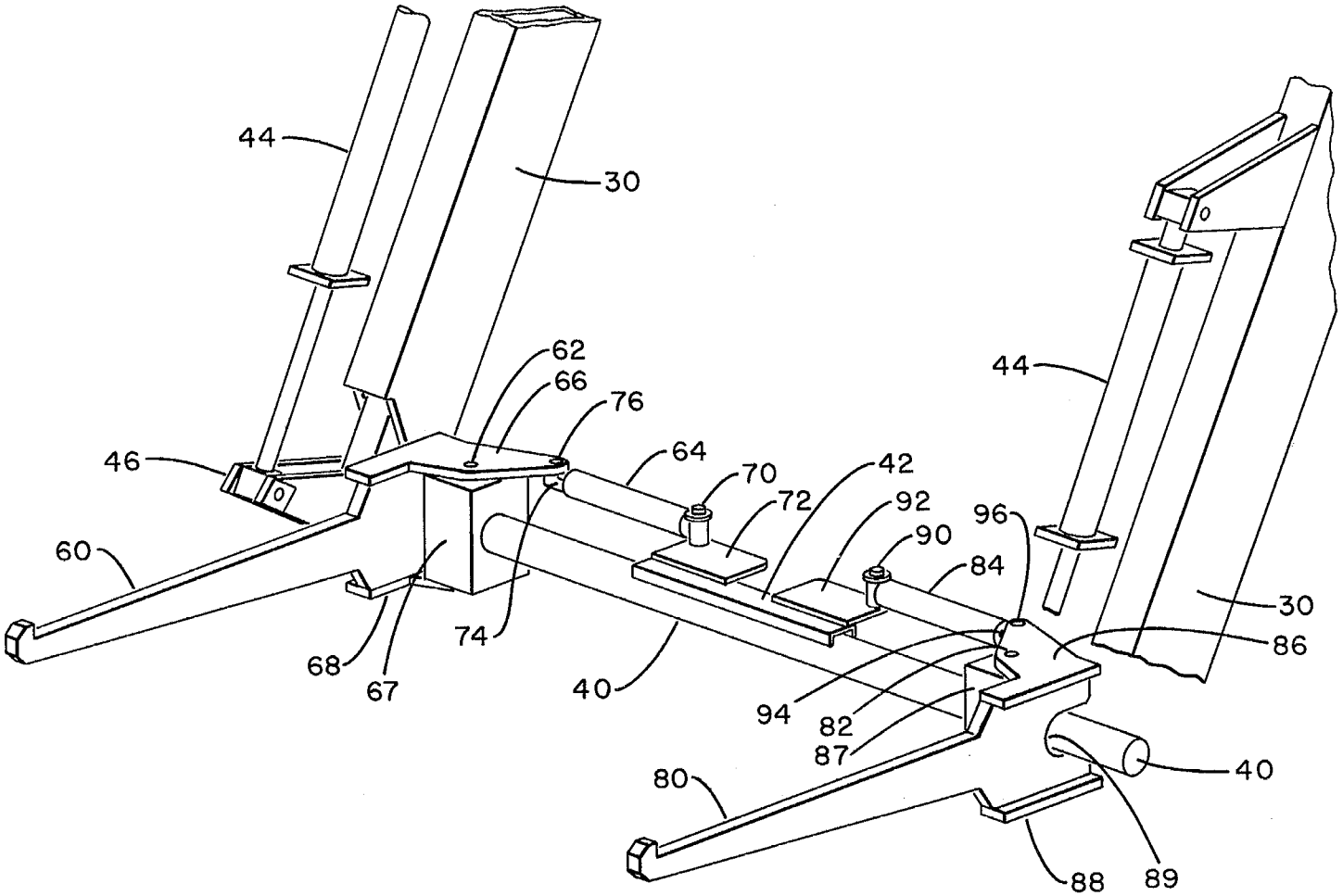
FIG. 1 is a front perspective of the fork arms and portions of the lift arms of a lifting and dumping apparatus constructed according to the present invention.

As illustrated in FIG. 1, a pair of fork arms, a right fork arm 60 and a left fork arm 80, are positioned on the right and left sides, respectively, of the tube or cross member 40. The fork arms 60 and 80 are pivotally mounted on the tube 40 by means of top bracket plates 66 and 86, bottom bracket plates 68 and 88, and pins 62 and 82 which extend radially through the front tube. Top bracket plate 66 is attached to one end of pin 62, bottom bracket plate 68 is attached to the other end of pin 62, and both bracket plates 66 and 68 are rotatable about the axis of the pin 62. The faces of the bracket plates 66 and 68 are generally perpendicular to the axis of the pin 62, and the back end of the right fork arm 60 is rigidly secured between the faces of these top and bottom bracket plates. Similarly, top bracket plate 86 is attached to one end of pin 82, bottom bracket plate 88 is attached to the other end of pin 82, and both bracket plate 86 and 88 are rotatable about the axis of the pin 82. The faces of the bracket plates 86 and 88 are generally perpendicular to the axis of the pin 82, and the back end of the left fork arm 80 is rigidly secured between the faces of these top and bottom bracket plates. Spacing member 67 is mounted on the front tube 40 between the top bracket plate 66 and the bottom bracket plate 68 to provide extra support for the top bracket plate and to prevent the bracket plates and the right fork arm 60 from sliding in the direction of the axis of the pin 62. Likewise, spacing member 87 is mounted on the front tube 40 between the top bracket plate 86 and the bottom bracket plate 88 to provide extra support for the top bracket plate 86 and to prevent these bracket plates and the left fork arm 80 from sliding in the direction of the axis of the pin 82. In addition, in a preferred embodiment, the back end of the fork arms 60 and 80 contain identical notches 89 in order that the front tube 40 can receive and support the fork arms when they are positioned as shown in FIG. 1.

When the lift arms 30 are in their lower position and the fork arms 60 and 80 are horizontal, the pins 62 and 82 are generally vertical and the fork arms can pivot horizontally about the pins. The left fork arm 80 is spaced from the right fork arm 60 a distance sufficient to allow the left fork arm to pivot about the pin 82 towards the center, or inside, of the front tube 40 without striking the right fork arm. Also, the fork arms 60 and 80, the top bracket plates 66 and 86, and the bottom bracket plates 68 and 88 are spaced from the front ends of the lift arms 30 and the levers 46 a distance adequate to permit the fork arms to pivot about the pins 62 and 82 towards the center of the front tube 40 without the bracket plates or the back ends of the fork arms striking the lift arms or the levers. Thus, the fork arms 60 and 80 can pivot about the pins 62 and 82 between an open or extended position and a closed or folded position. In the open position the fork arms 60 and 80 are generally perpendicular to the front tube 40 and project forward of the lift arms 30 for engagement with a detachable refuse container, and in the closed or folded position the fork arms are generally parallel to the front tube so that their projection forward of the lift arms is eliminated.

It should be understood that it is not necessary to the present invention that the pins 62 and 82 extend through the front tube 40 or that the pins be free to rotate about their respective axes. For example, the pins 62 and 82 could be rigidly secured to the top of the front tube 40 and protrude upwards from the front tube without extending through the front tube, and the top bracket plates 66 and 86 could be pivotally secured to the pins with the fork arms 60 and 80 being secured to the top bracket plates. In this manner, the top bracket plates 66 and 86 and the fork arms 60 and 80 could rotate about the axes of the pins 62 and 82 without the pins either being rotatable or extending through the front tube 40.

Similarly, as may be obvious from the above discussion, it is not necessary to the present invention that there be top bracket plates 66 and 86 and bottom bracket plates 68 and 88. The apparatus of the present invention could function with just the pair of top bracket plates 66 and 86 or just the pair of bottom bracket plates 68 and 88; but the two pair of bracket plates are preferred because two pair offer a good combination of cost, strength, and durability.

A pair of hydraulic cylinders 64 and 84, referred to as the folding hydraulic cylinders, are positioned just rearward of the front tube 40 for pivoting the fork arms 60 and 80 about pins 62 and 82. Hydraulic cylinder 64 is positioned to the right of the center of the front tube 40 between the center of the front tube and the pin 62, and the head end of the hydraulic cylinder 64 is pivotally connected by means of a pin 70 to a plate 72 that is secured to a front bracket 42 which, in turn, is securely mounted on top of the mid portion of the front tube 40. In a like manner, hydraulic cylinder 84 is positioned to the left of the center of the front tube 40 between the center of the front tube and the pin 82, and the head end of the hydraulic cylinder 84 is pivotally connected by means of a pin 90 to a plate 92 that is secured to the front bracket 42. In this preferred embodiment, the piston rods 74 and 94 of the folding hydraulic cylinders 64 and 84 are pivotally connected by pins 76 and 96 to top bracket plates 66 and 86 rearward of the point at which the top bracket plates are secured to pins 62 and 82. Thus, when the piston rods 74 and 94 are extended, the top bracket plates 66 and 86 rotate about pins 62 and 82 and the fork arms 60 and 80 pivot about the pins towards the center of the front tube 40. Since bottom bracket plates 68 and 88 are rigidly secured to the fork arms 60 and 80, they too rotate about pins 62 and 82 as the fork arms pivot.

This particular arrangement for connecting the folding hydraulic cylinders 64 and 84 to the fork arms 60 and 80 is not necessary to the present invention. Other ways of connecting the folding hydraulic cylinders 64 and 84 to the fork arms 60 and 80 will be apparent to one skilled in the art. For example, the hydraulic cylinders 64 and 84 could be positioned between the pins 62 and 82 and the ends of the front tube 40, instead of the center of the front tube 40, and connected to the top bracket plates 66 and 86 in order that extension of the piston rods 74 and 94 opens the fork arms 60 and 80 instead of closing them. Also, the hydraulic cylinders 64 and 84 could be positioned forward of the front tube 40 rather than rearward of the tube.

Figure 3:
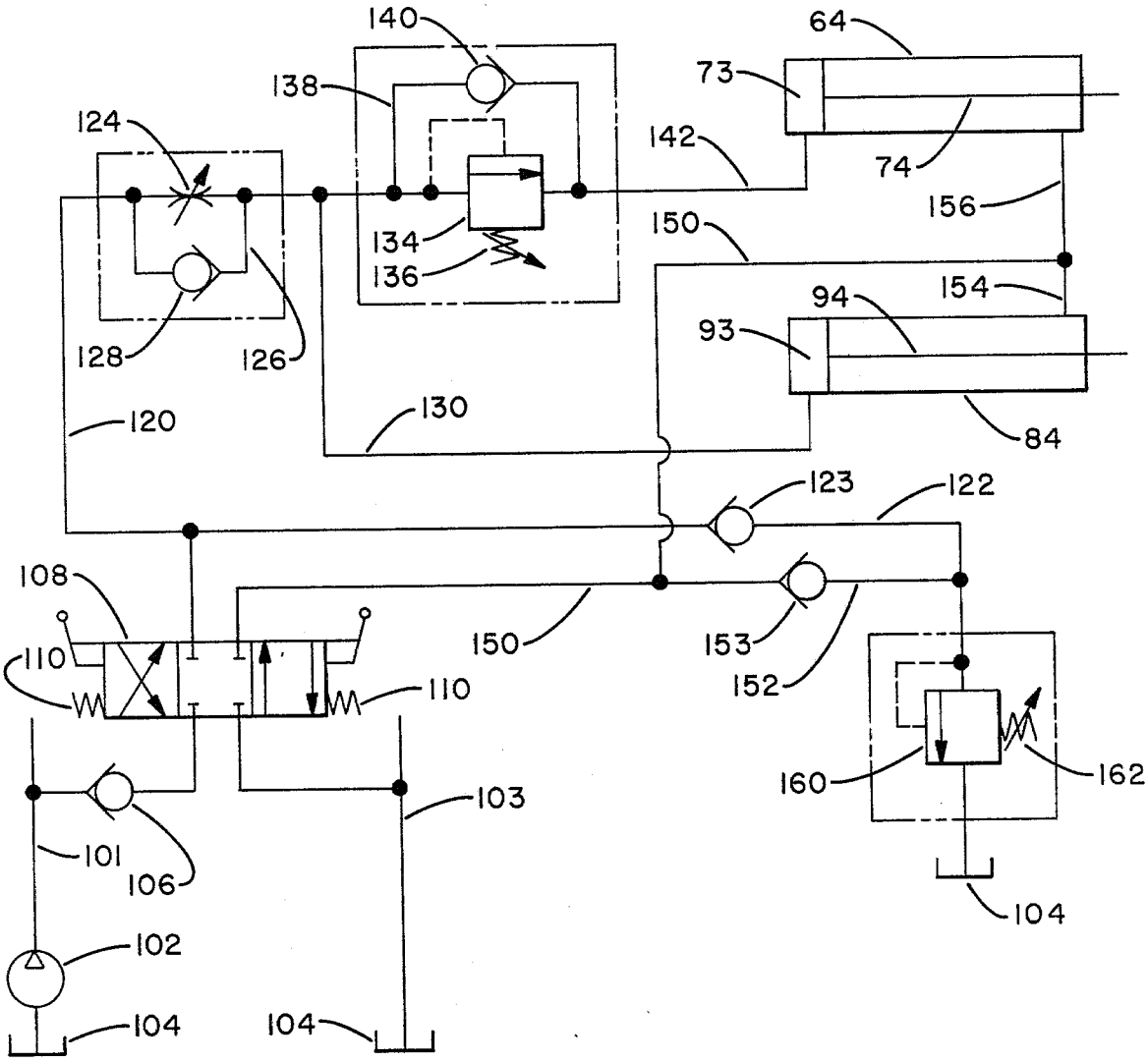
FIG. 3 is a schematic diagram of the hydraulic circuit used to pivot the fork arms shown in FIG. 1 between the open position and the closed position.

The hydraulic circuit for operating the folding hydraulic cylinders 64 and 84 is shown schematically in FIG. 3. The circuit comprises generally a hydraulic fluid pump 102, a fluid reservoir 104, a three position control valve 108, a flow control valve 124, a sequence valve 134, and a relief valve 160. The right and left folding hydraulic cylinders 64 and 84 are shown schematically, and the piston rods 74 and 94 are shown schematically as being connected to pistons 73 and 93 in the hydraulic cylinders. Hydraulic fluid from reservoir 104 is used to operate all the hydraulic cylinders on the vehicle 10. Generally, the pump 102 draws fluid from the reservoir 104, pressurizes the fluid, and discharges the pressurized fluid to the various hydraulic fluid circuits. Fluid line 101 connects the hydraulic circuit shown in FIG. 3 to the pump 102, and line 103 connects this circuit to the reservoir 104. The three position control valve 108 is biased toward the center position by opposed springs 110; and when the control valve 108 is in the center position, as shown in FIG. 3, fluid is trapped in each folding hydraulic cylinder 64 and 84 so that the fork arms 60 and 80 are held stationary with respect to the front tube 40.

To close or fold the fork arms 60 and 80, the three position control valve 108 is moved to the left as viewed in FIG. 3. Hydraulic fluid is drawn from the reservoir 104 by pump 102 and discharged through fluid line 101 and through check valve 106 which maintains pressure in the downstream portion of the hydraulic circuit in the event the pump 102 should, for some reason, lose pressure. After passing through the check valve 106, the hydraulic fluid passes through he three position control valve 108 to fluid line 120. The fluid then passes through line 120 to the flow control valve 124. Flow control valve 124 slows the flow of hydraulic fluid through the circuit and this slows the closing of the fork arms 60 and 80. In this manner, in case an obstruction enters the path of the fork arms 60 and 80 as they close, the operator of the vehicle 10 can stop the closing of the fork arms by moving the three position control valve 108 to the center position before any damage is done to the fork arms or to the obstruction. A by-pass fluid line 126 is provided to allow fluid to by-pass the flow control valve 124, but line 126 contains a check valve 128 that allows fluid to flow through the by-pass line 126 only when the fork arms 60 and 80 are being opened.

Figure 4:
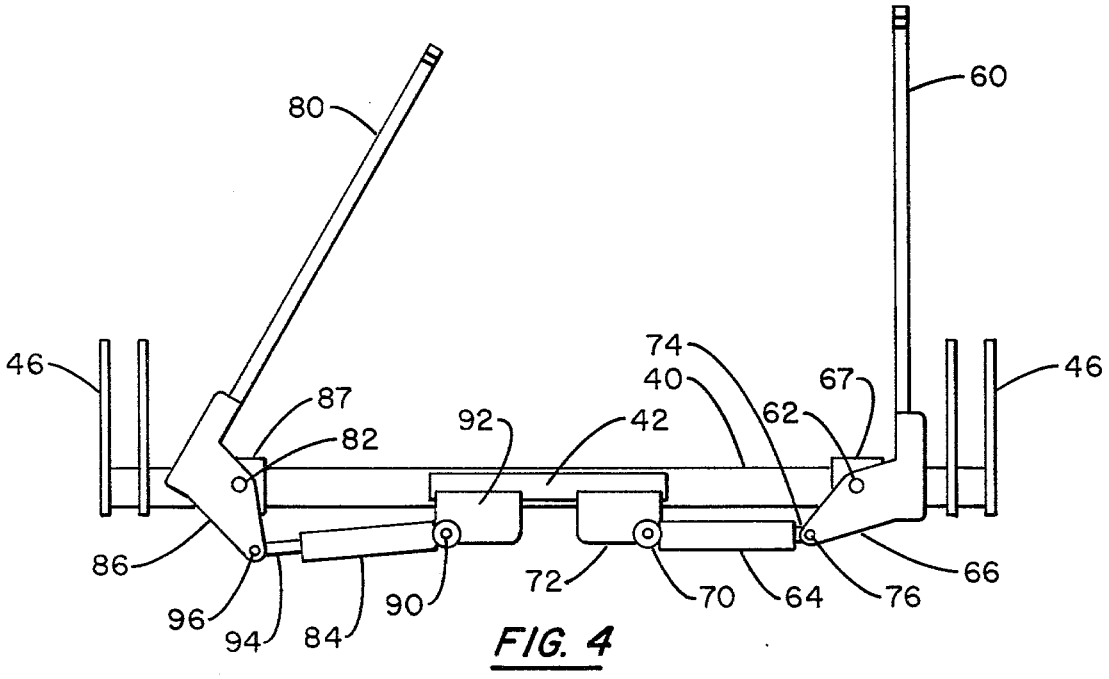
FIG. 4 is a top plan view of FIG. 1 showing the left fork arm midway between its open position and its closed position as it pivots from its open position to its closed position.

When both fork arms 60 and 80 are in the open position, the fluid, after passing through the flow control valve 124, is prevented from entering fluid line 142 by check valve 140 and by sequence valve 134 to be described, and as a result the hydraulic fluid enters line 130. From fluid line 130, the fluid enters the head end of the left folding hydraulic cylinder 84. The hydraulic fluid pushes the piston 93 out towards the piston end of the cylinder 84 which extends the piston rod 94. Fluid forced out of the piston end of the cylinder 84 passes through branch line 154 to fluid line 150, through line 150, through the three position control valve 108, to fluid line 103, and to the reservoir 104. Referring now to FIGS. 1 and 4, as the cylinder piston rod 94 is pushed out the top bracket plate 86 rotates about pin 82 and the left fork arm 80 pivots toward the center of the front tube 40. FIG. 4 shows the left fork arm 80 midway between its open and closed positions as it pivots from its open position to its closed position. The left fork arm 80 can continue to pivot about pin 82 until the fork arm contacts the front tube 40. When this occurs, the left fork arm 80 is in its folded or closed position and is generally parallel to the front tube 40. The front tube 40 blocks the left fork arm 80 from further movement and this prevents the piston rod 94 from being extended any further. Referring back to FIG. 3, since the piston 93 cannot move any closer to the piston end of the cylinder 84, no more fluid can enter the head end of the cylinder. This prevents hydraulic fluid from flowing through fluid line 130, and this causes the fluid to open and pass through the sequence valve 134 in the manner described below.

Sequence valve 134 is a pilot operated pressure valve biased toward the closed position by a spring 136. The valve is set to open at a pressure greater than that which is necessary to fold the left fork arm 80 but less than that of the fluid flowing through the circuit. A by-pass line 138 is provided to allow fluid to by-pass the sequence valve 134, but line 138 contains a check valve 140 that allows fluid to flow through the by-pass line 138 only when the fork arms 60 and 80 are being opened. Thus, as the fork arms 60 and 80 are closed, the sequence valve 134 remains closed until the left fork arm 80 is completely folded and then opens so that fluid can flow through the sequence valve 134 to close the right fork arm 60. Sequencing the closing of the fork arms 60 and 80 in this manner prevents the fork arms from striking and blocking each other as they close.

Figure 5:
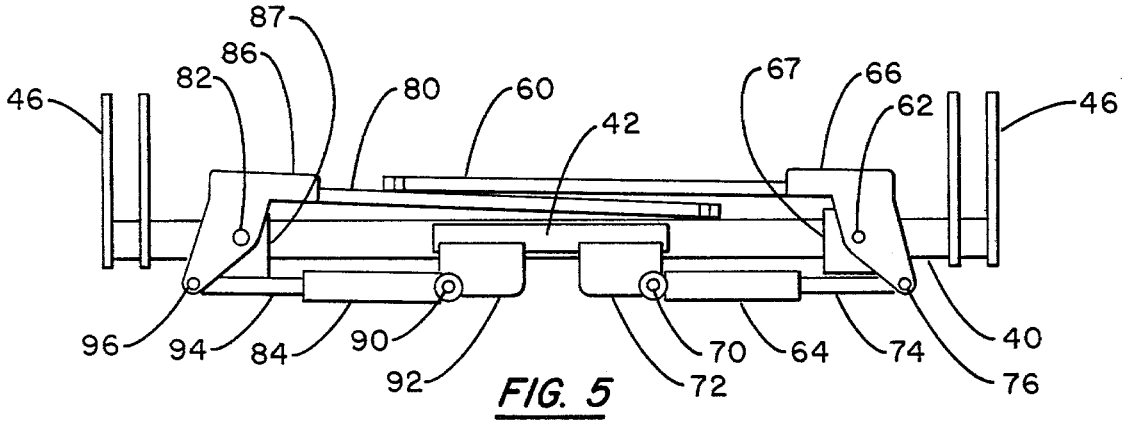
FIG. 5 is a top plan view of FIG. 1 with the fork arms in the closed position.

Consequently, after the left fork arm 80 is closed, the hydraulic fluid, after passing through the flow control valve 124, flows through the sequence valve 134, through fluid line 142, and into the head end of the right folding hydraulic cylinder 64. The fluid pushes the piston 73 out toward the piston end of the cylinder 64 which extends the piston rod 74. Hydraulic fluid forced out of the piston end of the cylinder 64 passes through branch line 156 to fluid line 150 and to the fluid reservoir 104. Referring to FIGS. 1 and 5, as the cylinder piston rod 74 is pushed out the top bracket plate 66 rotates about pin 62 and the right fork arm 60 pivots toward the center of the front tube 40. The right fork arm 60 can continue to pivot about pin 62 until the right fork arm 60 contacts the left fork arm 80. When this occurs, as shown in FIG. 5, the right fork arm 60 is in its folded or closed position and generally parallel to the front tube 40. The fork arms 60 and 80 are now both completely folded. As will be apparent to one skilled in the art, it is not necessary to the present invention that the left fork arm 80 close before the right fork arm 60. Nor is it necessary that one fork arm completely close before the second one starts to close. However, sequencing the closing of the fork arms 60 and 80 in the manner described herein is a simple, reliable, and inexpensive means of insuring that the fork arms do not block each other as they close.

Again referring back to FIG. 3, the hydraulic circuit is provided with a relief valve 160. The valve 160 is a pilot operated pressure valve that is biased toward the closed position by a spring 162 and is set to open at a pressure lower than that which can be normally supplied by the pump 102. This limits the pressure in the circuit to the forks. Since the pump 102 is generally operated by the engine of the vehicle 10, limiting the pressure in the hydraulic circuit reduces the horsepower demand on the engine while the fork arms 60 and 80 and being opened and closed. The relief valve 160 is connected to fluid lines 120 and 150 by, respectively, relief lines 122 and 152 so that the single relief valve 160 can limit the fluid pressure in the circuit regardless of the direction of the flow of fluid through the circuit. Check valves 123 and 153 are positioned, respectively, in relief lines 122 and 152 and prevent pressurized hydraulic fluid from flowing in series through the relief lines.

Figure 6:
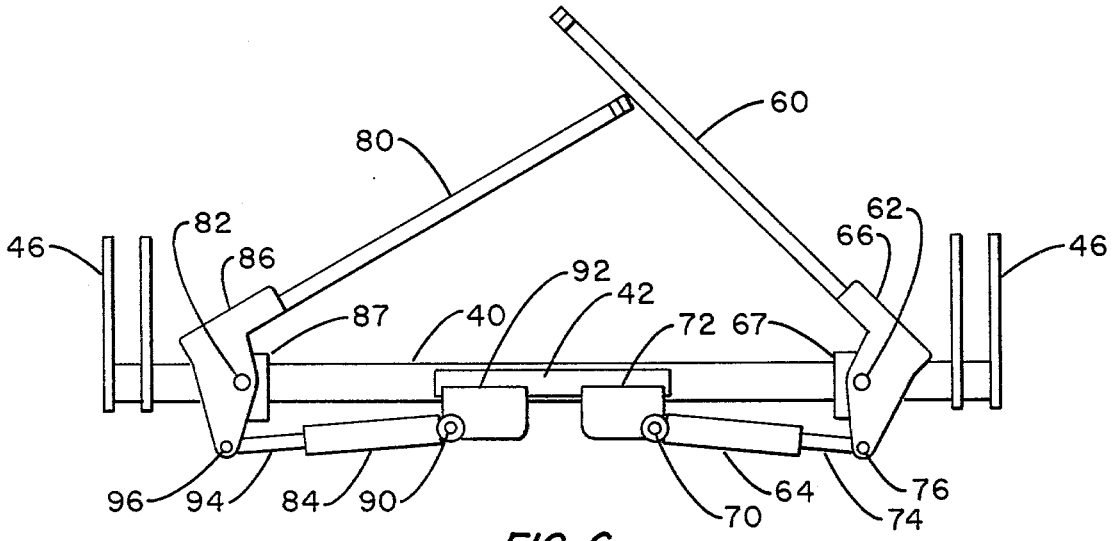
FIG. 6 is a top plan view of FIG. 1 showing the fork arms between the closed position and the open position as they pivot from the closed position to the open position.

To open or extend the fork arms 60 and 80, the three position control valve 108 is moved to the right as viewed in FIG. 3. Fluid is drawn from the reservoir 104 by pump 102 and discharged through fluid line 101, through check valve 106, through the three position control valve 108, and to fluid line 150. The hydraulic fluid flows through line 150 to branch lines 154 and 156 which direct the fluid to the piston ends of, respectively, the left and right folding hydraulic cylinders 84 and 64. The hydraulic fluid pushes the cylinder pistons 73 and 93 towards the head ends of the cylinders 64 and 84 causing the piston rods 74 and 94 to retract. Fluid forced out of the left hydraulic cylinder 84 passes through line 130, through check valve 128, through fluid line 120, through the three position control valve 108, and through line 103 to the fluid reservoir 104. Fluid forced out of the right hydraulic cylinder 64 passes through line 142, through check valves 140 and 128, through fluid line 120, through the three position control valve 108, and through line 103 to the fluid reservoir 104. Referring to FIGS. 1 and 6, as the piston rods 74 and 94 retract, the top bracket plates 66 and 86 rotate about pins 62 and 82 and the fork arms 60 and 80 pivot outwardly away from the front tube 40. The piston rods 74 and 84 retract simultaneously so that the right and left fork arms 60 and 80 are opened simultaneously. FIG. 6 shows the right fork arm 60 and the left fork arm 80 midway between the open and closed positions as they pivot from the closed position to the open position. The piston rods 74 and 94 continue to retract until they have completely retracted, at which time the three position control valve 108 is moved to its center position as viewed in FIG. 3 locking the fork arms 60 and 80 in place. The piston rods 74 and 94 are designed so that when they are completely retracted, the fork arms 60 and 80 are in their open position for engagement with a detachable refuse container.

To better illustrate the manner in which the present invention functions, the refuse vehicle 10 will be described for emptying one refuse container and moving to a second container.

The refuse vehicle 10, with its lift arms 30 in their lower position as shown in full lines in FIG. 2 and with its fork arms 60 and 80 substantially horizontal, generally perpendicular to the front tube 40, is positioned in front of a detachable refuse container of the type shown in FIG. 2 and designated as 2. The container 2 has sides which are spaced apart a distance slightly less than the distance between the lift arms 30 and the opposite sides of the container are provided with sleeves 4 for receiving the fork arms 60 and 80 of the refuse vehicle 10.

To dump the contents of the container 2 into the body 18 of the refuse vehicle 10, the fork arms 60 and 80 are inserted into the container sleeves 4 by moving the refuse vehicle forward, and, as illustrated by FIG. 2, the lift arms 30 are then rotated by inward movement of the piston rods of the lifting hydraulic cylinders 34. As the lift arms 30 are raised, the piston rods of the dumping hydraulic cylinders 44 at first are pushed out thereby rotating the front tube 40 counterclockwise as viewed in FIG. 2 to keep the fork arms 60 and 80 and the refuse container 2 substantially horizontal. This prevents spillage of the contents of the container 2. As the lift arms 30 continue to be raised and the container 2 is moved to a position above the body 18, the piston rods of the dumping hydraulic cylinders 44 now are pulled in rotating the refuse container clockwise as viewed in FIG. 2 and causing the contents of the container to be dumped into the body 18 of the vehicle 10. This position of the lift arms 30 and the refuse container 2 is indicated in phantom lines at A in FIG. 2. The lifting hydraulic cylinders 34 and the dumping hydraulic cylinders 44 can operate together automatically as disclosed in U.S. Pat. No. 3,827,589, granted on Aug. 6, 1974, to Harvey W. Liberman et al.

To return the container 2 to the ground, the movement of the lifting and dumping hydraulic cylinders, 34 and 44 respectively, is reversed. When the container 2 is on the ground, the refuse vehicle 10 is moved backwards to disengage the fork arms 60 and 80 from the container sleeves 4. Referring to FIG. 1 as well as FIG. 2, the fork arms 60 and 80 are then closed by an outward movement of the piston rods 74 and 94 of the folding hydraulic cylinders 64 and 84. Folding the fork arms 60 and 80 in this manner eliminates their projection forward of the lift arms 80. This reduces the effective length of the vehicle 10 allowing the vehicle to proceed to the next refuse container with greater maneuverability. After the operator has reached the location of the next container, the fork arms 60 and 80 are opened by an inward movement of the piston rods 74 and 94 of the folding hydraulic cylinders 64 and 84. The fork arms 60 and 80 are automatically in a horizontal position ready to engage the second container because the front tube 40 has not been rotated since the first container was disengaged. This second refuse container can then be engaged and dumped in the same manner as described above.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. A lifting and dumping apparatus for dumping the contents of a container into the body of a vehicle including:

a pair of lift arms pivotally secured to the vehicle for movement between a lower position in which the front portions of the lift arms extend forward of the vehicle and an upper position in which the front portions of the lift arms extend above the vehicle;

lift arm power means to move the lift arms between their lower and upper positions;

a front cross member extending between and rotatably supported by the front portions of the lift arms;

a pair of fork arms for engaging the container;

attaching means to secure the fork arms to the front cross member, and including two pins extending from the front cross member wherein the pins are generally vertical when the fork arms engage the container, two bracket plates wherein each bracket plate is pivotally supported by a pin and each fork arm is secured to a bracket plate for pivotal movement therewith between an open position and a closed position, wherein the fork arms extend forward of the lift arms for engagement with the container, and a closed position, wherein the fork arms are generally parallel to the front cross member, and spacing members mounted on the front cross member and extending between the front cross member and the bracket plates to prevent the bracket plates from sliding along the axes of the pins and to support the bracket plates for pivotal movement thereabout, and wherein back ends of the fork arms define notches for receiving the front cross member as the fork arms move into the open position wherein the front cross member supports the fork arms when the fork arms are in the open position;

dumping means connected to the lift arms and the front cross member for rotating the front cross member, and pivoting the fork arms about the axis of the front cross member; and fork arm power means to pivot the fork arms between their open and closed positions, and including a pair of hydraulic cylinders, each having a movable piston rod connected to one of the bracket plates to pivot the fork arms between their open and closed positions, and a hydraulic fluid circuit connected to the hydraulic cylinders to move the piston rods thereof, and including sequencing means to alternately pivot the fork arms from their open position to their closed position.

2. A lifting and dumping apparatus as defined by claim 1 wherein each bracket plate is pivotally attached to a hydraulic cylinder rearward of the position at which the bracket plate is attached to a pin.

3. A lifting and dumping apparatus as defined by claim 2 wherein:

each pin extends through the front cross member with a top end protruding above the front cross member and a bottom end protruding below the front cross member;

each bracket plate is attached to the top end of a pin; and the attaching means further includes two bottom bracket plates with each bottom bracket plate attached to the bottom end of a pin and rigidly secured to a fork arm so that the bottom bracket plate pivots about the axis of the pin as the fork arm pivots between its open position and its closed position.

* * * * *

UNITED STATES PATENT AND TRADEMARK OFFICE

CERTIFICATE OF CORRECTION

PATENT NO. : 4,349,305

DATED : September 14, 1982

INVENTOR(S) : Charles C. Wynn and Donald J. Hopkins

It is certified that error appears in the above-identified patent and that said Letters Patent are hereby corrected as shown below:

Column 1, line 34, change "means" to ---arms---.

Column 1, line 67, change "arm" to ---arms---.

Column 4, line 8, change "plate" to ---plates---.

Column 8, line 67, change "80" to ---30---.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*